US006888946B2

(12) United States Patent
Bachmann et al.

(10) Patent No.: US 6,888,946 B2
(45) Date of Patent: May 3, 2005

(54) HIGH FREQUENCY LOUDSPEAKER

(75) Inventors: Wolfgang Bachmann, Grevenbroich (DE); Gerhard Krump, Schwarzach (DE); Hans-Juergen Regl, Regensburg (DE); Andreas Zinganki, Mettmann (DE)

(73) Assignee: Harman Audio Electronic Systems GmbH, Straubing (DE)

( * ) Notice: Subject to any disclaimer, the term of this patent is extended or adjusted under 35 U.S.C. 154(b) by 259 days.

(21) Appl. No.: 09/838,886

(22) Filed: Apr. 20, 2001

(65) Prior Publication Data

US 2001/0055403 A1 Dec. 27, 2001

(30) Foreign Application Priority Data

May 23, 2000 (DE) ..... 100 25 460

(51) Int. Cl.[7] ..... H04R 25/00

(52) U.S. Cl. ..... 381/184; 181/171; 181/172; 181/173; 381/431; 381/425; 381/395; 381/398; 381/423

(58) Field of Search ..... 381/164, 174, 381/431, 425, 184, 395, 398, 423, 424; 181/171, 172, 173, 293, 288

(56) References Cited

U.S. PATENT DOCUMENTS

| | | | | |
|---|---|---|---|---|
| 3,347,335 | A | * 10/1967 | Watters | |
| 4,300,655 | A | * 11/1981 | Sakamoto et al. | |
| 6,151,402 | A | * 11/2000 | Azima | |
| 6,188,775 | B1 | * 2/2001 | Azima et al. | 381/431 |
| 6,275,598 | B1 | 8/2001 | Bachmann et al. | 381/425 |
| 6,327,329 | B1 | * 12/2001 | Bromberg et al. | |
| 6,442,282 | B2 | * 8/2002 | Azima et al. | 381/152 |
| 6,519,349 | B1 | * 2/2003 | Azima et al. | 381/396 |

FOREIGN PATENT DOCUMENTS

| | | |
|---|---|---|
| EP | 0 924 959 | 12/1998 |
| WO | WO 97/09842 | 3/1997 |

* cited by examiner

*Primary Examiner*—Huyen Le
*Assistant Examiner*—Dionne Harvey

(57) ABSTRACT

A tweeter with a light, thin sandwich plate which can be excited into multiple reflected bending waves, and a driver which makes a vibrating contact and excites the sandwich plate, where the driver is designed for higher sound frequencies and the sandwich plate for propagating bending waves with low damping. The sandwich plate is freely carried with low damping by holding elements, where the latter are designed to be low damping at higher sound frequencies.

24 Claims, 4 Drawing Sheets

HIGH FREQUENCY LOUDSPEAKER

TECHNICAL FIELD

The invention concerns a tweeter with a light, thin sandwich plate which can be excited into multiple reflected bending waves, and a driver with a vibrating connection to the sandwich plate for exciting it to vibrate.

BACKGROUND OF THE INVENTION

Plate loudspeakers are known in several variations of very different constructions and radiation characteristics. They only have in common that the sound radiating surface (diaphragm) is flat or only slightly bowed, i.e. it has bending radii which are much larger than the diagonal of the diaphragm. One form of plate loudspeakers is formed for example of electrostats which comprise a distributed high voltage drive, a flat metallized foil diaphragm, bulb-shaped radiation characteristics which are sharply bundled in the medium and high sound range. Another form are so-called magnetostats with a distributed electrodynamic drive, a flat metallized foil diaphragm and bulb-shaped radiation characteristics which are sharply bundled in the medium and high sound range. By contrast, absorber plates have a thin, vibration-damped, flat-laid foil diaphragm and a centrally positioned electrodynamic drive. They permit heavily damped bending wave propagation without any edge reflection, and are therefore resonance-free. So-called planars also have an electrodynamic drive, they have a flat rigid plate as the diaphragm and bulb-shaped radiation characteristics which are sharply bundled in the medium sound range. There the operating frequency range lies under the first bending vibration resonance. Finally, multiresonance plates also have an electrodynamic drive, a flat, light, bending-resistant, freely supported plate as the diaphragm. They have irregular, omnidirectional radiation characteristics, and an operating frequency range which lies under up to well above the first bending vibration resonance. Loudspeakers constructed in accordance with this principle are called multiresonance plate loudspeakers (DML=Distributed Mode Loudspeaker).

The feared bending wave resonances from cone loudspeakers should not always be expected to be harmful in plate loudspeakers. With suitable excitation and clamping techniques, material selection and plate structure, the bending vibration resonances could even form the main part of the sound event, thereby producing a new and pleasant sound experience. Such plate loudspeakers are known for example from WO 97/09842 or EP 0 924 959 A2.

The attraction of multiresonance plate loudspeakers for the user is that only a thin plate is used instead of boxes. The reproduction in the medium sound range is indisputably good. However, reproduction in the highest treble range or even in the deep ultrasonic range demanded by hi-fi audiophiles (for example 20 kHz to 50 kHz) is a problem. For that reason as yet there is no multiresonance plate loudspeaker on the market for the highest sound range.

SUMMARY OF THE INVENTION

It is therefore the object of the invention to indicate a multiresonance plate loudspeaker which can operate in the highest treble range.

The object is achieved in a tweeter comprising a light, freely carried thin sandwich plate which can be excited into multiple reflected bending waves; and at least one driver which makes vibrating contact with and excites the sandwich plate, wherein the driver is designed to excite at higher sound frequencies, the sandwich plate is designed for the propagation of bending waves with low damping, the sandwich plate is freely supported by holding elements with low damping, and that the holding elements are designed to be low damping at higher sound frequencies.

Among other things the invention provides that the driver is suitable for the excitation at higher sound frequencies. The sandwich plate is designed for the propagation of bending waves with low damping, where the sandwich plate has holding elements which support it freely and have low damping. The holding elements are designed to be low damping at higher sound frequencies.

Because of the extremely low stroke in the micrometer range in combination with the short bending wavelength (e.g. 30 mm at 20 kHz), drivers which are not suitable for the medium and deep sound range are used, and vice versa. Separate driver supports are preferably not used. Such a drive system is characterized in that it very efficiently excites the sandwich plate into bending vibrations.

A preferred electrodynamic ultrahigh sound driver contains for example only three parts: one part is formed by a radially polarized magnetic disk in a miniature format, using a rare earth magnetic material. Furthermore a moment bearing is provided, which is cemented to the magnetic disk and to the panel. A third part formed by the voice coil of the ultrahigh sound driver is also cemented to the panel.

Accordingly a piezoelectric ultrahigh sound driver can also be built of three parts. In that case a brass plate is provided which has a polarized piezoceramic substrate installed on one or on both sides. In addition it again has a moment bearing which is cemented to the piezo disk and the panel. A moment ring is directly cemented to the panel. The moment ring and the moment bearing can also be replaced by shaping the metal support plate accordingly (for example by deep drawing or embossing), to create a one-piece piezoelectric driver.

The sandwich plate preferably has two thin, hard cover plates and an interposed, shear-proof, thin core layer. The core layer can have a honeycomb structure. It offers high mechanical stiffness with low weight. The core layer can furthermore contain a spatially different distribution of the elasto-mechanical properties, which can be achieved for example by thinning and/or cutting out the core layer and/or the cover layer. The zone dimensions can be designed and arranged so that a basic pattern is always repeated in a reduced scale and is again repeated in these smaller structures.

These measures by themselves, and particularly in combination with each other, increase the shear strength of the sandwich plate.

The hard, thin cover plates can be made of metal or glass or carbon fiber reinforced synthetic resin. For example aramid is used as a honeycomb material.

The core layer comprises at least one foil which has periodically repeated bulges such as for example knobs, pyramids, cylinders or similar applied by stamping techniques. The form, arrangement and direction of the bulges are such that maximum shear strength is achieved in all moment directions. In one configuration of the invention all bulges are knobs in the form of a square based, four-sided pyramid. The knobs are arranged in strictly periodic, closely adjacent straight rows in the same direction, where alternatingly each second row only contains knobs facing in the opposite direction. Each row is offset by half a knob with respect to the neighboring rows.

A further development of the invention provides that the holding elements are suitable for placement or insertion into larger support structures. For example one side of the holding elements is attached to the sandwich plate with a brittle-hard adhesive, and the other side is connected to the support structure. To that end the holding elements may have edges, where at least one edge is always cemented in a brittle-hard manner into a suitable recess in the support structure. The backside of the driver can be formed into a holding element. Finally the plate diaphragm of a deep and/or medium plate tweeter can be built as a support structure. But every other solid structure can also be used as a holder, such as for example television set housings, the internal trim of automobiles, furniture doors, etc. In addition because of their superior radiation characteristics multiresonance plate tweeters can also be used in conventional boxes.

The following sandwich plate properties are essential for operating the tweeter of the invention:

a) Low bending vibration damping in the surface and on the edges;

b) the bending resonance is preferably under the operating frequency band;

c) the bending wavelength is small with respect to the surface diagonal.

The invention achieves these properties with an extremely thin and extremely light sandwich plate. It may begin with a three-layer sandwich plate of little thickness. One layer for example is a 2 mm thick honeycomb core with cover foil plates made of metal or glass fiber reinforced synthetic resin for example. The surface diagonal is also kept small (e.g. 20 cm).

In a further development a reduction of the mass can be achieved by zonal thinning or recesses. This achieves a uniform distribution of the point impedance on the plate surface since the impedance is space-dependent in real plates. The recess patterns on the multiresonance plate are organized so that a basic pattern is repeated in a reduced scale, and that further reduced images take place in the repeated smaller structures. This type of arrangement is a "fractal" pattern.

Another further development achieves a smaller reflection loss from the plate holder, where a freely carrying support is provided at selected points in recesses of the edge area and in the center of the plate. Such supports can also be appropriately prepared drivers. It is especially advantageous if the holding elements are cemented in a brittle-hard manner. This construction also achieves a deep basic bending wave resonance under 500 Hz for example, resulting in a very high characteristic frequency density in the effective frequency range. Furthermore in the operating frequency band of the sandwich plate of the invention the bending wave speed is on the order of 5000 m/s. The bending wave lengths are on the order of about 3 cm in this case and are therefore clearly smaller than the 20 cm plate diagonal, for instance.

The extremely thin, extremely light core layer of the sandwich plate can be made for example of a Nomex honeycomb, a hard foam, or a thin metal foil with an embossed knob pattern. The metal foil with the knob pattern has the advantage of relatively low cost production.

BRIEF DESCRIPTION OF THE DRAWINGS

The invention is explained in greater detail in the following by means of the embodiments illustrated in the figures of the drawings, where.

BEST MODE FOR CARRYING OUT THE INVENTION

Figure 1:
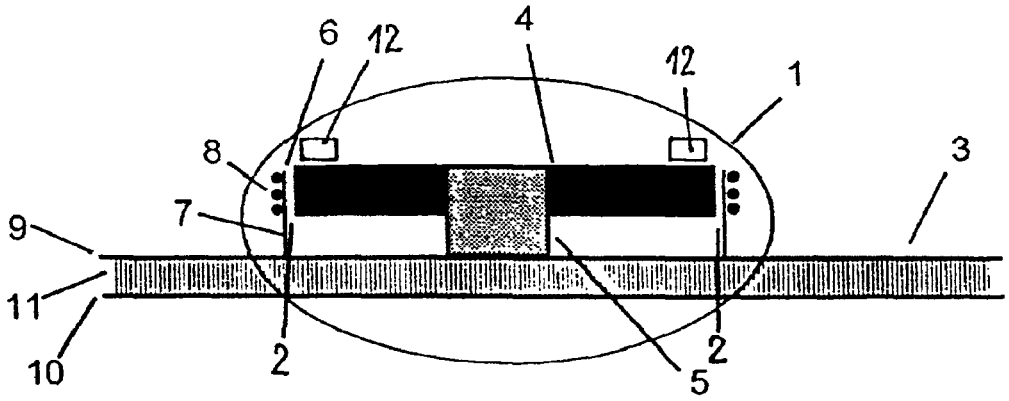
FIG. 1 is an electrodynamic driver for a tweeter according to the invention.

FIG. 1 shows a cross section of an electrodynamic treble driver 1. A radially polarized, annular permanent magnet 4 of the rare earth type is attached to the sandwich plate 3 with an adhesive via a centrally cemented and centrally positioned coupling disk 5. A voice coil 6 with a coil brace 7 and a coil winding 8 concentrically surrounds the permanent magnet 4 to form a vibrating gap 2. The voice coil 6 is directly cemented to the sandwich plate 3. The sandwich plate 3 itself is composed of the hard cover plates 9, 10 and a light, shear resistant core 11 which is located between the cover plates 9 and 10 and is tightly connected thereto.

In addition the arrangement is advantageously expanded around a holding fixture, so that the back side of the permanent magnet 4 is provided with a support structure 12 which serves as a holding fixture for the entire treble plate loudspeaker. A different type of holding fixture can also be provided instead of the support structure 12.

Figure 2:
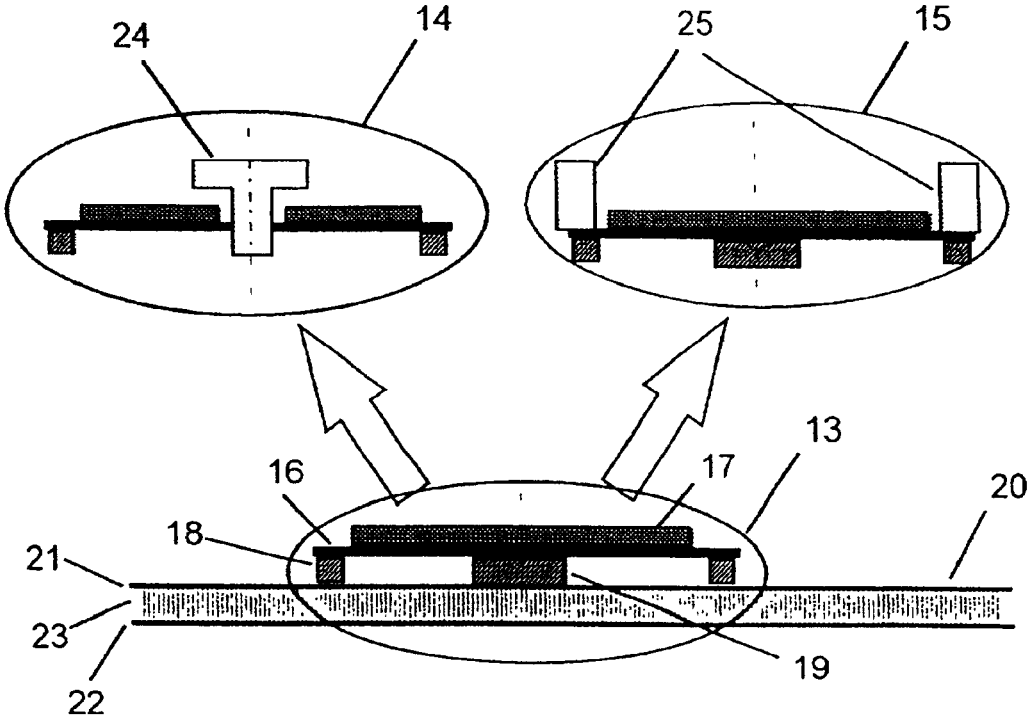
FIG. 2 is a first configuration of a piezoelectric driver for a tweeter according to the invention.

FIG. 2 shows a cross section of a three-part piezoelectric treble driver in 3 different configurations 13, 14 and 15. The piezoelectric treble driver 13 has a metal support plate 16 and a radially polarized piezoceramic substrate 17 applied thereto (on one side or both sides), and is designed to produce a radial contraction or expansion in response to an axially operating electrical field. The support plate 16 is held by a centrally placed coupling disk 19 and concentrically by a coupling ring 18. The coupling disk 19 and the coupling ring 18 are cemented to the support plate 16 and to a sandwich plate 20 which in turn is composed of a rear cover plate 21, a front cover plate 22 and a sandwich core 23.

The treble driver 14 in FIG. 2 comes from the treble driver 13 where a centrally placed supporting foot 24 is provided to hold the entire treble loudspeaker above the treble driver 14. Accordingly the treble driver 15 in FIG. 2 also comes from the treble driver 13 in that it is equipped with a support ring 25 as the holding element.

Figure 3:
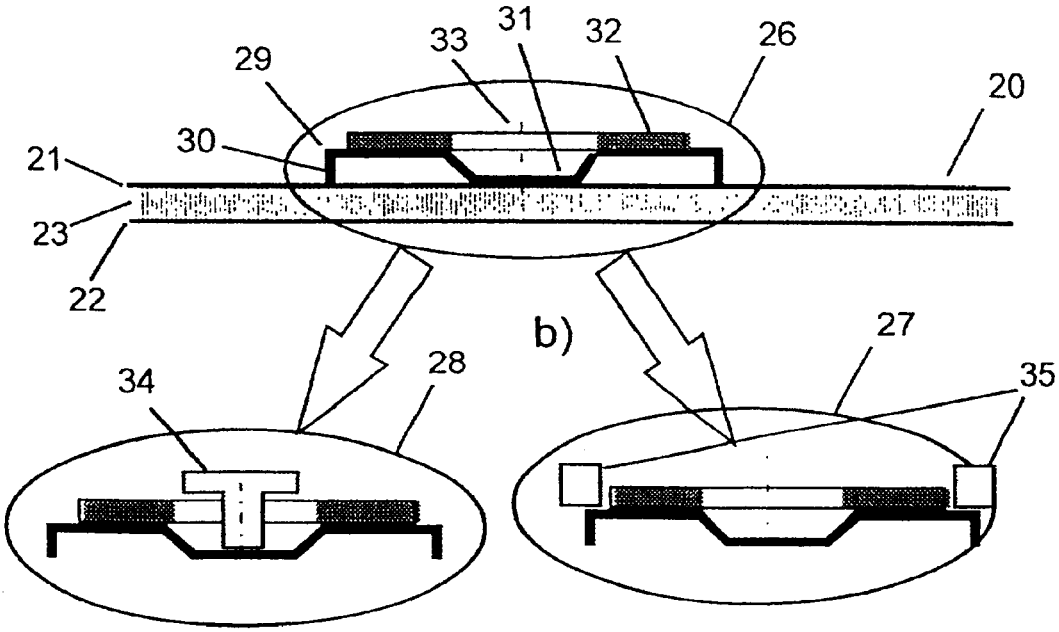
FIG. 3 is a second configuration of a piezoelectric driver for a tweeter according to the invention.

FIG. 3 shows a cross section of a one-piece piezoelectric treble driver in three configurations 26, 27 and 28. The stress-free form of an external coupling ring 30 is embossed from an originally flat metal support plate, as well as a central coupling knob 31. A radially polarized piezoceramic substrate 32 with a central cutout 33 is placed on this embossed support plate 29. The coupling ring 30 and the coupling knobs 31 of the support plate 29 are cemented to the sandwich plate 30.

The treble driver 27 differs from treble driver 26 by an additional support ring 35, which is also used to hold the entire treble loudspeaker above treble driver 27. As an alternative to the coupling ring 35, the treble driver 28 contains a support foot 34.

Figure 4:
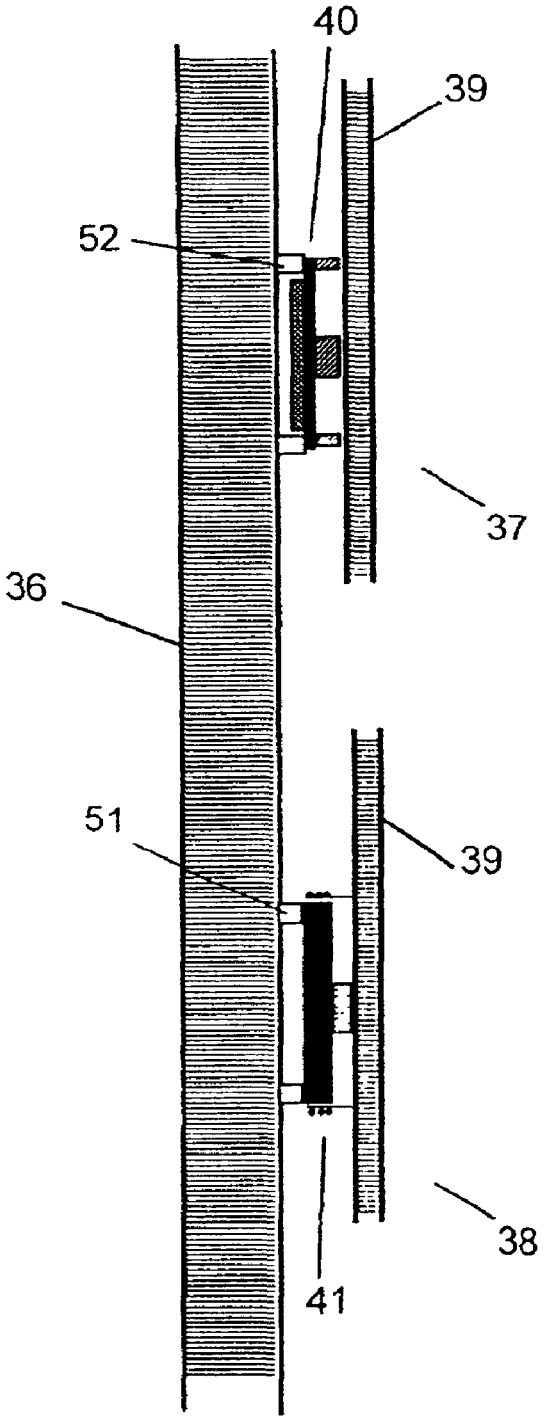
FIG. 4 is a first configuration of a holding fixture for a tweeter according to the invention.

FIG. 4 shows two treble loudspeakers 37 and 38 of the invention which are installed on the diaphragm 36 of a (significantly larger) medium/deep sound plate loudspeaker. The piezoelectric treble loudspeaker 37 is composed of a diaphragm 39 and a piezoelectric driver 40. With the help of the support ring 51 it is in a position to receive the static load of the driver 40. In the same way a support ring 52 allows the electrodynamic treble loudspeaker 38, which is composed of a diaphragm 39 and an electrodynamic driver 41, to receive the static load of the driver 41.

Figure 5:
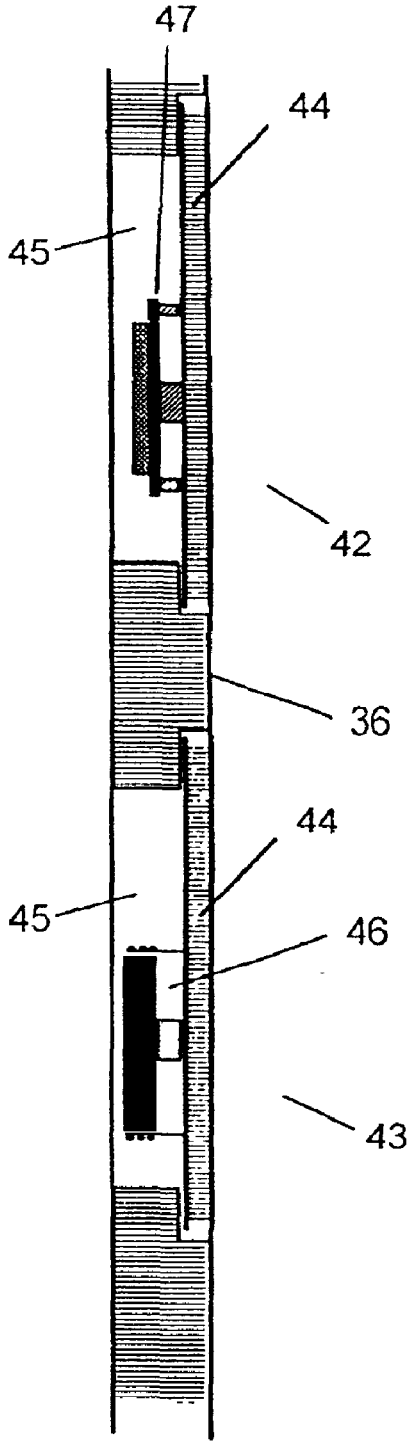
FIG. 5 is a second configuration of a holding fixture for a tweeter according to the invention.

FIG. 5 shows another alternative, where two treble loudspeakers 42 and 43 of the invention are inserted into the diaphragm 36 of the medium/deep sound plate loudspeaker. The piezoelectric treble loudspeaker 42 with diaphragm 44 and piezoelectric driver 47 is inserted into a stepped cutout 45 of the medium/deep sound diaphragm 36.

Figure 6:
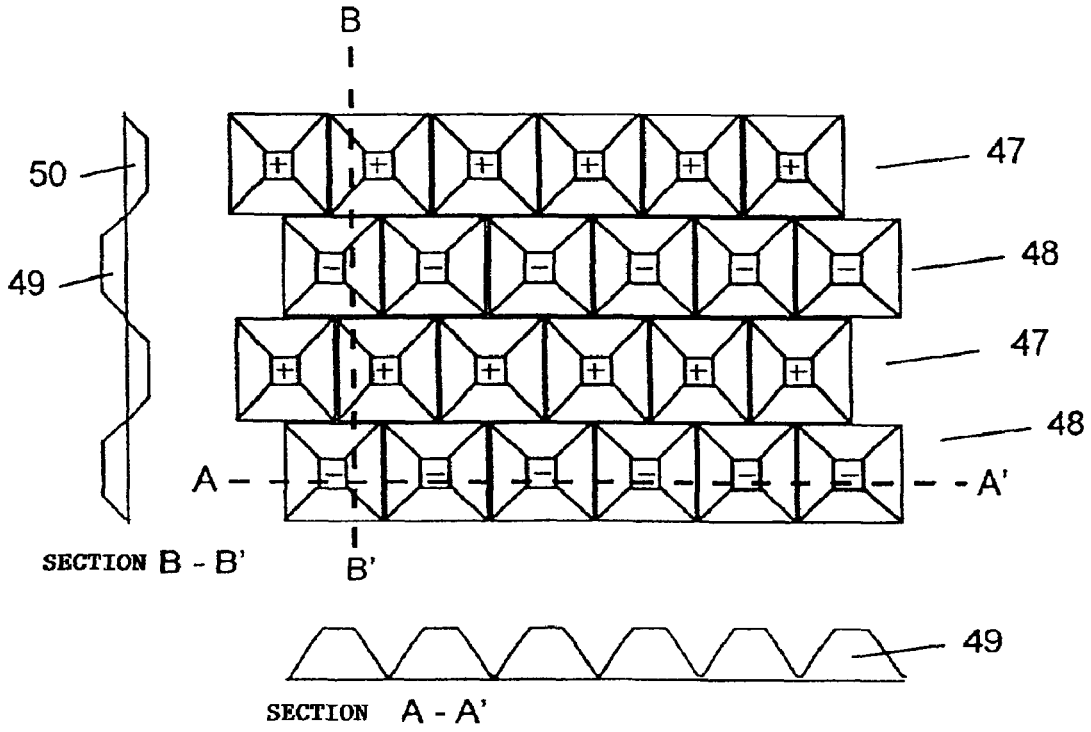
FIG. 6 is a configuration of a dimensionally stable knob profile.

The dimensionally stable knob profile shown in FIG. 6 can be used as the sandwich core of a treble multiresonance plate loudspeaker. The matrix-type arrangement is composed of alternating rows of aligned knobs 50, such as for example rows 47 with knobs 50 which are embossed toward the front (+) and alternate with rows 48 containing knobs 49 that protrude toward the rear (−). As shown in FIG. 6, rows 47 and 48 are offset from each other by half a knob. Without this offset, the sandwich core would be very soft when it is bent in one direction. But the offset produces a higher stiffness against shearing along two parallel axes of the knob edges.

Figure 7:
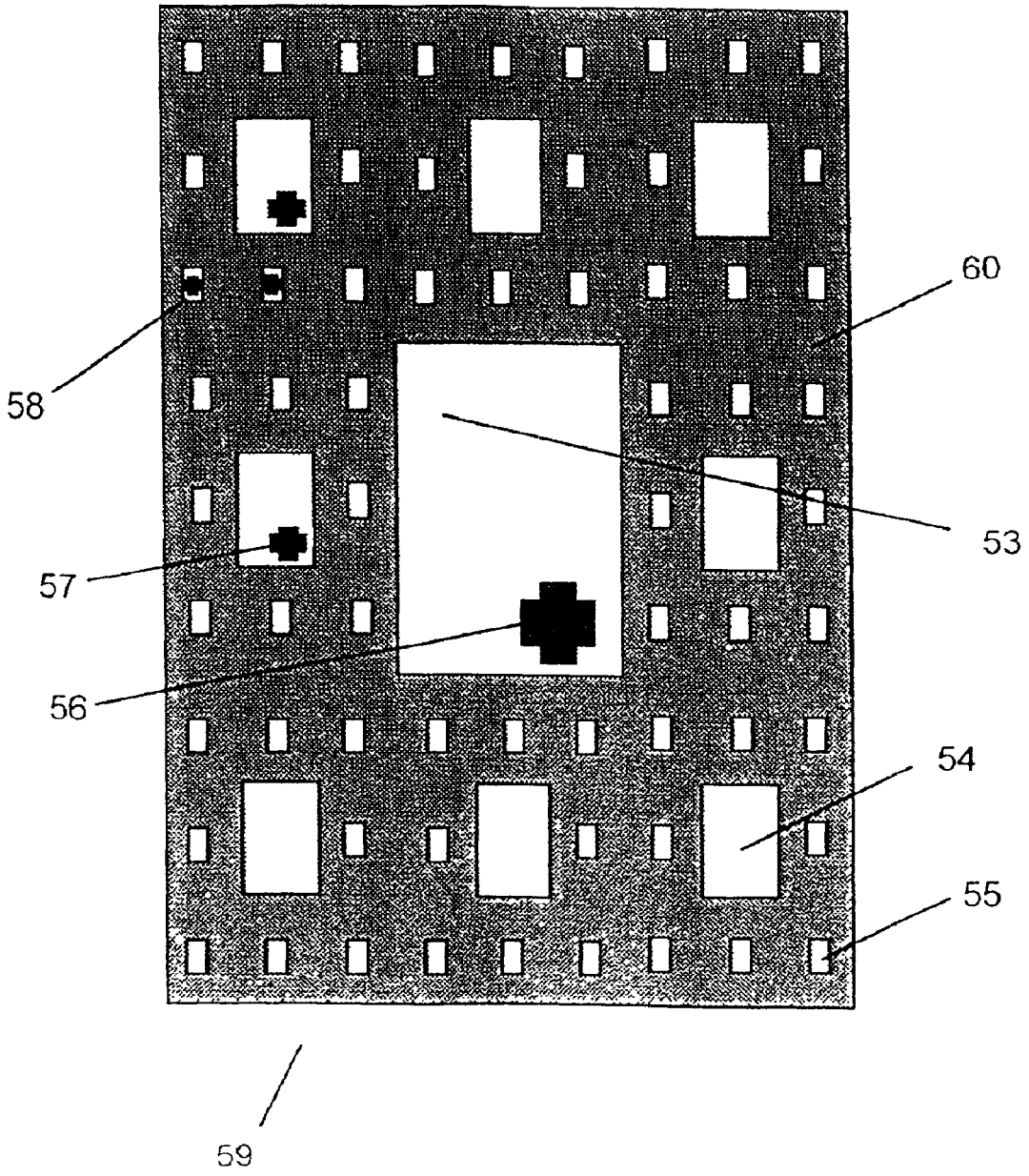
FIG. 7 is a configuration of a fractal pattern.

In a top view of the diaphragm surface FIG. 7 shows a fractal pattern 59 of (for example) rectangular structural changes applied to a sandwich panel 60. The entire rectangular surface contains a fractal pattern 59 for example in the form of rectangular structural changes. Here the entire rectangular surface also contains a rectangle 53 as the form of the structurally changed zone, which is a central rectangle resulting from a uniform 3×3 subdivision of the original shape. The (imagined) remaining eight rectangles of equal size again contain a central rectangular structural change 54, which again is the result of a 3×3 division. In another corresponding step even smaller rectangles 55 are then formed in the same way.

For example, large 56, medium large 57 or small 58 drivers can be inserted in accordance with the size of the structurally changed zones 53, 54 and 55 (FIG. 7).

Having described the invention, what is claimed is:

1. A tweeter comprising:

a light, freely carried thin sandwich plate (3, 20, 39, 60) which can be excited into multiple reflected bending waves; and at least one driver (1, 13, 14, 15, 26, 27, 28, 40, 41) which makes vibrating contact with and excites the sandwich plate (3, 20, 39, 60), wherein the driver (1, 13, 14, 15, 26, 27, 28, 40, 41) is designed to excite at higher sound frequencies, the sandwich plate (3, 20, 39, 60) is designed for the propagation of bending waves with low damping, the sandwich plate (3, 20, 39, 60) is freely supported by holding elements (12, 24, 25, 34, 35) with low damping, and the holding elements (12, 24, 25, 34, 35) are designed to be low damping at higher sound frequencies, wherein the bending waves have wavelengths which are small with respect to a surface diagonal of the sandwich plate, and wherein the sandwich plate has a bending resonance under a band containing the higher sound frequencies.

2. A tweeter as claimed in claim 1, wherein the sandwich plate (3) has two thin, hard cover plates (9, 10) with a shear resistant, thin core layer (11) placed between them.

3. A tweeter as claimed in claim 2, wherein the core layer (11) has a honeycomb structure.

4. A tweeter as claimed in claim 3, wherein the core layer (11) contains a spatially different distribution of the elasto-mechanical properties.

5. A tweeter as claimed in claim 4, wherein zonal thinning or cutouts (53 to 55) are provided in the core layer or the cover layers.

6. A tweeter as claimed in claim 5, wherein the size and arrangement of the zones (53 to 55) is such that a basic pattern is always repeated in a reduced scale.

7. The tweeter of claim 6, wherein the pattern has a fractal arrangement.

8. A tweeter as claimed in claim 2, wherein the core layer (11) contains a spatially different distribution of the elasto-mechanical properties.

9. A tweeter of claim 1, wherein the sandwich plate (3) has two thin, hard cover plates (9, 10) with a shear resistant, thin core layer (11) placed between them, wherein the core layer (11) contains a spatially different distribution of the elasto-mechanical properties, wherein zonal thinning or cutouts (53 to 55) are provided in the core layer or the cover layers, wherein the size and arrangement of the zones (53 to 55) is such that a basic pattern is always repeated in a reduced scale, and wherein the core layer includes a foil which contains periodically repeated bulges (31) produced by embossing.

10. A tweeter as claimed in claim 9, wherein the bulges are shaped, arranged and directed such that the maximum shear resistance is obtained in all moment directions.

11. A tweeter as claimed in claim 1, wherein the holding elements (12, 24, 25, 34, 35) are suitable to be placed or inserted into a larger support structure (36).

12. A tweeter as claimed in claim 11, wherein one side of the holding elements is attached with a brittle-hard adhesive to the sandwich plate, and the other side is connected to the support structure.

13. A tweeter as claimed in claim 12, wherein the holding elements have edges, and that the edges are cemented in a brittle-hard manner to a cutout in the support structure.

14. A tweeter as claimed in claim 11, wherein the back side of the driver (40, 41, 46, 47) is designed as a holding element.

15. A tweeter as claimed in claim 11, wherein the plate diaphragm of a deep or medium sound plate loudspeaker is designed as a support structure (36).

16. A tweeter comprising: a light, freely carried thin sandwich plate (3, 20, 39, 60) which can be excited into multiple reflected bending waves, at least one driver (1, 13, 14, 15, 26, 27, 28, 40, 41) which makes vibrating contact with and excites the sandwich plate (3, 20, 39, 60), wherein the driver (1, 13, 14, 15, 26, 27, 28, 40, 41) is designed to excite at higher sound frequencies, the sandwich plate (3, 20, 39, 60) is designed for the propagation of bending waves with low damping, the sandwich plate (3, 20, 39, 60) is freely supported by holding elements (12, 24, 25, 34, 35) with low damping, and that the holding elements (12, 24, 25, 34, 35) are designed to be low damping at higher sound frequencies, wherein the sandwich plate (3) has two thin, hard cover plates (9, 10) with a shear resistant, thin core layer (11) placed between them, wherein the core layer (11) contains a spatially different distribution of the elasto-mechanical properties, wherein zonal thinning or cutouts (53 to 55) are provided in the core layer or the cover layers, wherein the size and arrangement of the zones (53 to 55) is such that a basic pattern is always repeated in a reduced scale, wherein the core layer includes a foil which contains periodically repeated bulges (31) produced by embossing, wherein the shape, arrangement and direction of the bulges is such that the maximum shear resistance is obtained in all moment directions, and wherein the bulges are knobs (49, 50) in the form of a square based, four-sided pyramid, and the knobs (49, 50) are arranged to face in the same direction in strictly periodic, closely adjacent straight rows (47, 48), where each second row (48) alternatingly contains knobs in the opposite direction, and each row (47) is offset by half a knob (49, 50) with respect to the neighboring rows (48).

17. A tweeter as claimed in claim 16, wherein the holding elements (12, 24, 25, 34, 35) are suitable to be placed or inserted into a larger support structure (36).

18. A tweeter as claimed in claim 17, wherein one side of the holding elements is attached with a brittle-hard adhesive to the sandwich plate, and the other side is connected to the support structure.

19. A tweeter as claimed in claim 18, wherein the holding elements have edges, and that the edges are cemented in a brittle-hard manner to a cutout in the support structure.

20. A tweeter as claimed in claim 19, wherein the back side of the driver (40, 41, 46, 47) is designed as a holding element.

21. A tweeter as claimed in claim 20, wherein the plate diaphragm of a deep or medium sound plate loudspeaker is designed as a support structure (36).

22. A tweeter comprising:

a light, freely carried thin sandwich plate (3, 20, 39, 60) which can be excited into multiple reflected bending waves;

at least one driver (1, 13, 14, 15, 26, 27, 28, 40, 41) which makes vibrating contact with and excites the sandwich plate (3, 20, 39, 60), wherein the driver (1, 13, 14, 15, 26, 27, 28, 40, 41) is designed to excite at higher sound frequencies, the sandwich plate (3, 20, 39, 60) is designed for the propagation of bending waves with low damping, the sandwich plate (3, 20, 39, 60), is freely supported by holding elements (12, 24, 25, 34, 35) with low damping, and that the holding elements (12, 24, 25, 34, 35) are designed to be low damping at higher sound frequencies, wherein the sandwich plate (3) has two thin, hard cover plates (9, 10) with a shear resistant, thin core layer (11) placed between them, wherein the core layer (11) contains a spatially different distribution of the elasto-mechanical properties, wherein zonal thinning or cutouts (53 to 55) are provided in the core layer or the cover layers, wherein the size and arrangement of the zones (53 to 55) is such that a basic pattern is always repeated in a reduced scale, wherein the core layer includes a foil which contains periodically repeated bulges (31) produced by embossing, and wherein the bulges are knobs (49, 50) in the form of a square based, four-sided pyramid, and the knobs (49, 50) are arranged to face in the same direction in strictly periodic, closely adjacent straight rows (47, 48), where each second row (48) alternatingly contains knobs in the opposite direction, and each row (47) is offset by half a knob (49, 50) with respect to the neighboring rows (48).

23. A tweeter comprising:

a light, freely carried thin sandwich plate (3, 20, 39, 60) which can be excited into multiple reflected bending waves; and at least one driver (1, 13, 11, 15, 26, 27, 28, 40, 41) which makes vibrating contact with and excites the sandwich plate (3, 20, 39, 60), wherein the driver (1, 13, 11, 15, 26, 27, 28, 40, 41) is designed to excite at higher sound frequencies, the sandwich plate (3, 20, 39, 60) is designed for the propagation of bending waves with low damping, the sandwich plate (3, 20, 39, 60) is freely supported by holding elements (12, 21, 25, 34, 35) with low damping, and that the holding elements (12, 24, 25, 34, 35) are designed to be low damping at higher sound frequencies, wherein the sandwich plate (3) has two thin, hard cover plates (9, 10) with a shear resistant, thin core layer (11) placed between them, wherein the core layer includes a foil which contains periodically repeated bulges (31) produced by embossing, and wherein the bulges are knobs (49, 50) in the form of a square based, four-sided pyramid, and the knobs (49, 50) are arranged to face in the same direction in strictly periodic, closely adjacent straight rows (47, 48), where each second row (48) alternatingly contains knobs in the opposite direction, and each row (47) is offset by half a knob (49, 50) with respect to the neighboring rows (48).

24. The tweeter of claim 1 or claim 16 or claim 22, or claim 23, wherein the sandwich plate (3) has two thin, hard cover plates (9, 10) with a shear resistant, thin core layer (11) placed between them, and wherein the core layer includes a foil which contains periodically repeated bulges (31) produced by embossing.

* * * * *

UNITED STATES PATENT AND TRADEMARK OFFICE

CERTIFICATE OF CORRECTION

PATENT NO. : 6,888,946 B2
DATED : May 3, 2005
INVENTOR(S) : Bachmann et al.

It is certified that error appears in the above-identified patent and that said Letters Patent is hereby corrected as shown below:

Title page,
Item [56], References Cited, U.S. PATENT DOCUMENTS, please cancel
"6,327,329 B1 12/2001 Bromberg et al" and substitute
-- 6,327,369 B1 12/2001 Azima et al 381/152 -- therefor.

Column 6,
Line 17, please cancel "A" and substitute -- The -- therefor.

Column 7,
Line 44, please cancel ";" after "waves" and substitute -- , -- therefor; and
Line 50, please delete the comma after "60)".

Column 8,
Line 21, please cancel "11" and substitute -- 14 -- therefor;
Line 24, please cancel "11" and substitute -- 14 -- therefor; and
Line 29, please cancel "21" and substitute -- 24 -- therefor.

Signed and Sealed this

Ninth Day of August, 2005

JON W. DUDAS
*Director of the United States Patent and Trademark Office*